US009668627B2

(12) United States Patent
Kim et al.

(10) Patent No.: US 9,668,627 B2
(45) Date of Patent: Jun. 6, 2017

(54) ROBOT CLEANER

(71) Applicant: SAMSUNG ELECTRONICS CO., LTD., Suwon-si, Gyeonggi-do (KR)

(72) Inventors: Kyoung Woung Kim, Gwangju (KR); Kyu Ha Lee, Gwangju (KR); Seung Il Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/621,920

(22) Filed: Feb. 13, 2015

(65) Prior Publication Data

US 2015/0223653 A1 Aug. 13, 2015

(30) Foreign Application Priority Data

Feb. 13, 2014 (KR) ..... 10-2014-0016838

(51) Int. Cl.

*A47L 9/04* (2006.01)
*A47L 11/40* (2006.01)
*A47L 11/24* (2006.01)

(52) U.S. Cl.

CPC ..... *A47L 9/0411* (2013.01); *A47L 9/0427* (2013.01); *A47L 9/0438* (2013.01); *A47L 9/0477* (2013.01); *A47L 11/24* (2013.01); *A47L 11/4041* (2013.01); *A47L 11/4044* (2013.01); *A47L 11/4069* (2013.01); *A47L 2201/00* (2013.01)

(58) Field of Classification Search

CPC ..... A47L 9/041; A47L 9/0477; A47L 9/0427; A47L 11/24

See application file for complete search history.

(56) References Cited

U.S. PATENT DOCUMENTS

| | | | | |
|---|---|---|---|---|
| 7,827,653 | B1 | 11/2010 | Liu et al. | |
| 8,832,902 | B2 * | 9/2014 | Kim | A47L 9/0411 15/383 |
| 2007/0266508 | A1 | 11/2007 | Jones et al. | |
| 2008/0276407 | A1 * | 11/2008 | Schnittman | A47L 11/34 15/319 |
| 2009/0007366 | A1 | 1/2009 | Svendsen et al. | |
| 2012/0085190 | A1 | 4/2012 | Fu | |
| 2013/0000675 | A1 * | 1/2013 | Hong | A47L 9/009 134/18 |
| 2013/0086760 | A1 * | 4/2013 | Han | A47L 9/00 15/49.1 |

(Continued)

FOREIGN PATENT DOCUMENTS

| | | |
|---|---|---|
| EP | 1 604 603 A1 | 12/2005 |
| EP | 2 417 892 A1 | 2/2012 |
| KR | 10-2012-0024565 | 3/2012 |

OTHER PUBLICATIONS

European Search Report for Application No. 15154740.3-1712 dated Jul. 28, 2015.

*Primary Examiner* — Dung Van Nguyen
(74) *Attorney, Agent, or Firm* — Staas & Halsey LLP

(57) ABSTRACT

A robot cleaner drives various brushes using a single motor. The robot cleaner includes a main body having a suction port, a main brush rotatably disposed in the suction port, an auxiliary brush rotatably disposed adjacent to the main brush and at least one side brush rotatably installed to move dust to the suction port, wherein the main brush, the auxiliary brush, and the at least one side brush are driven by a single motor in an interlocking fashion.

15 Claims, 9 Drawing Sheets

(56) References Cited

U.S. PATENT DOCUMENTS

2013/0096717 A1* 4/2013 Yoon ..... A47L 11/33
700/245
2013/0326839 A1* 12/2013 Cho ..... A47L 9/2805
15/319

* cited by examiner

ROBOT CLEANER

CROSS-REFERENCE TO RELATED APPLICATIONS

This application claims the priority benefit of Korean Patent Application No. 10-2014-0016838, filed on Feb. 13, 2014 in the Korean Intellectual Property Office, the disclosure of which is incorporated herein by reference.

BACKGROUND

1. Field

One or more embodiments relate to a robot cleaner that drives various brushes using a single motor.

2. Description of the Related Art

A robot cleaner is an appliance that suctions foreign matter, such as dust, from an area to be cleaned so as to automatically clean the area while autonomously traveling in the area without user manipulation.

The robot cleaner detects the distance to an obstacle, such as furniture, office supplies, or walls, located in the area through various sensors and cleans the area while avoiding collision with the obstacle using detected information.

A fan is rotated by a motor to generate suction force and dust is scattered by a brush unit. Consequently, the robot cleaner suctions the dust together with external air. The motor is disposed under the fan along the same rotary shaft. When the rotary shaft is rotated by the motor, the fan connected to the rotary shaft is rotated to generate suction force.

The robot cleaner may include various brushes to more effectively suction dust. For example, the robot cleaner may include a main brush disposed in a suction port and a side brush disposed at a side of the suction port.

The main brush and the side brush are rotated by different motors. As a result, material cost is increased and the size of the robot cleaner is also increased.

In a case in which the height of the suction port is large, large-sized dust particles may be suctioned through the suction port but suction force is decreased. On the other hand, in a case in which the height of the suction port is small, suction force is increased but large-sized dust particles may not be suctioned through the suction port.

SUMMARY

The foregoing described problems may be overcome and/or other aspects may be achieved by one or more embodiments of a robot cleaner that drives various brushes using a single motor.

The foregoing described problems may be overcome and/or other aspects may be achieved by one or more embodiments of a robot cleaner including an auxiliary brush rotatable to move dust to a suction port, thereby assisting operation of a main brush.

Additional aspects of one or more embodiments will be set forth in part in the description which follows and, in part, will be obvious from the description, or may be learned by practice of one or more embodiments.

In accordance with one or more embodiments, a robot cleaner to remove dust from a surface to be cleaned may include a main body having a suction port, a main brush rotatably disposed in the suction port, an auxiliary brush rotatably disposed adjacent to the main brush, and at least one side brush rotatably installed to move the dust to the suction port, wherein the main brush, the auxiliary brush, and the at least one side brush may be driven by a single motor in an interlocking fashion.

The main brush and the auxiliary brush may be arranged in parallel to each other.

The main brush and the auxiliary brush may each include a rotary shaft parallel to the surface and the at least one side brush may include a rotary shaft perpendicular to the surface.

The motor may be connected to the main brush via a first connection member and the first connection member may interconnect a rotary shaft of the motor and one side of the main brush.

The main brush may be connected to the auxiliary brush via a second connection member.

The second connection member may interconnect one side of the main brush and one side of the auxiliary brush.

The second connection member may include at least one gear to interconnect the main brush and the auxiliary brush such that the main brush and the auxiliary brush may be rotatable in the same direction.

The second connection member may interconnect the one side of the main brush, one side of the auxiliary brush, and the at least one side brush.

The second connection member may include a plurality of gears having different speed reduction ratios such that the main brush, the auxiliary brush, and the at least one side brush may be rotatable at different speeds.

The auxiliary brush may be connected to the at least one side brush via a third connection member.

The third connection member may include a plurality of gears to interconnect the auxiliary brush rotating about a horizontal shaft and the at least one side brush rotating about a vertical shaft.

The main body may include an installation unit defining the suction port and the installation unit may include a first installation unit, in which the main brush may be installed, and a second installation unit, in which the auxiliary brush may be installed.

The auxiliary brush may include at least one blade to move the dust on the surface to the suction port.

The at least one blade may protrude perpendicular to an axial direction of the auxiliary brush to move the dust according to rotation of the auxiliary brush.

The auxiliary brush may be disposed in front of the main brush to move the dust on the surface to the suction port.

In accordance with one or more embodiments, a robot cleaner may include a motor, a main brush connected to the motor via a first connection member such that the main brush is rotatable, an auxiliary brush connected to the main brush via a second connection member such that the auxiliary brush may be rotatable while being interlocked with the main brush, and at least one side brush connected to the auxiliary brush via a third connection member such that the at least one side brush may be rotatable while being interlocked with the auxiliary brush.

The second connection member and the third connection member may each include at least one gear.

The at least one gear may be coupled at different speed reduction ratios such that the main brush, the auxiliary brush, and the at least one side brush may be rotatable at different speeds.

The motor may include a rotary shaft provided in a first direction, the main brush and the auxiliary brush may each include a rotary shaft provided in the first direction, and the at least one side brush may include a rotary shaft provided in a second direction perpendicular to the first direction.

The second connection member may be installed such that the second connection member may be rotatable about a rotary shaft provided in the first direction to interconnect the main brush and the auxiliary brush disposed in the first direction.

The third connection member may include at least one gear to interconnect the auxiliary brush disposed in the first direction and the at least one side brush provided in the second direction.

In accordance with one or more embodiments, a robot cleaner may include a main brush rotatably installed in a suction port and an auxiliary unit installed adjacent to the main brush, wherein the auxiliary unit may include an auxiliary brush installed to rotate about a rotary shaft provided in parallel to a rotary shaft of the main brush and at least one blade attached to the auxiliary brush to move dust to the suction port.

The robot cleaner may further include an installation unit defining the suction port, wherein the installation unit may include a first installation unit, in which the main brush may be installed, and a second installation unit, in which the auxiliary brush may be installed.

The first installation unit and the second installation unit may be provided to receive at least a portion of the main brush and at least a portion of the auxiliary brush, respectively.

The auxiliary unit may further include a connection member installed to interconnect one side of the main brush and one side of the auxiliary brush such that the auxiliary brush may be rotatable while being interlocked with the main brush.

The connection member may be installed such that the main brush and the auxiliary brush may be rotatable in the same direction.

The connection member may include a plurality of gears having different speed reduction ratios such that the main brush and the auxiliary brush may be rotatable at different speeds.

The at least one blade may protrude from the auxiliary brush to scatter dust on a surface to be cleaned while rotating according to rotation of the auxiliary brush.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
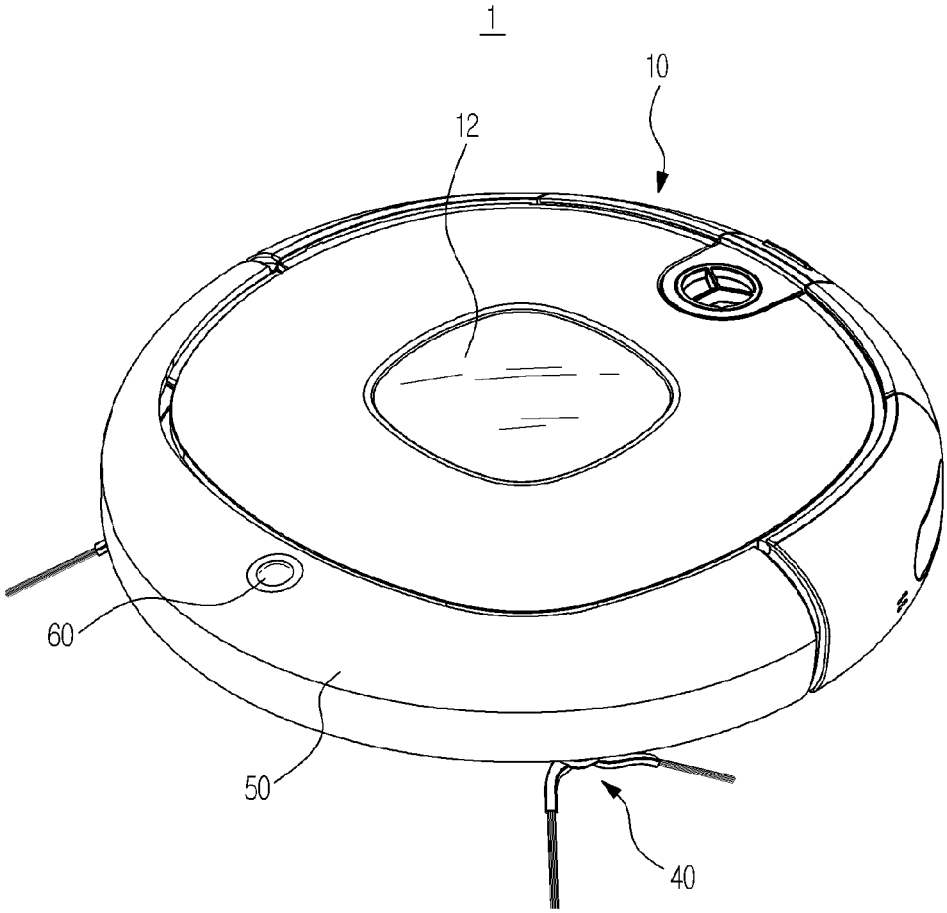
FIG. 1 is a view showing a robot cleaner according to one or more embodiments.

Reference will now be made in detail to one or more embodiments, examples of which are illustrated in the accompanying drawings, wherein like reference numerals refer to like elements throughout.

Figure 2:
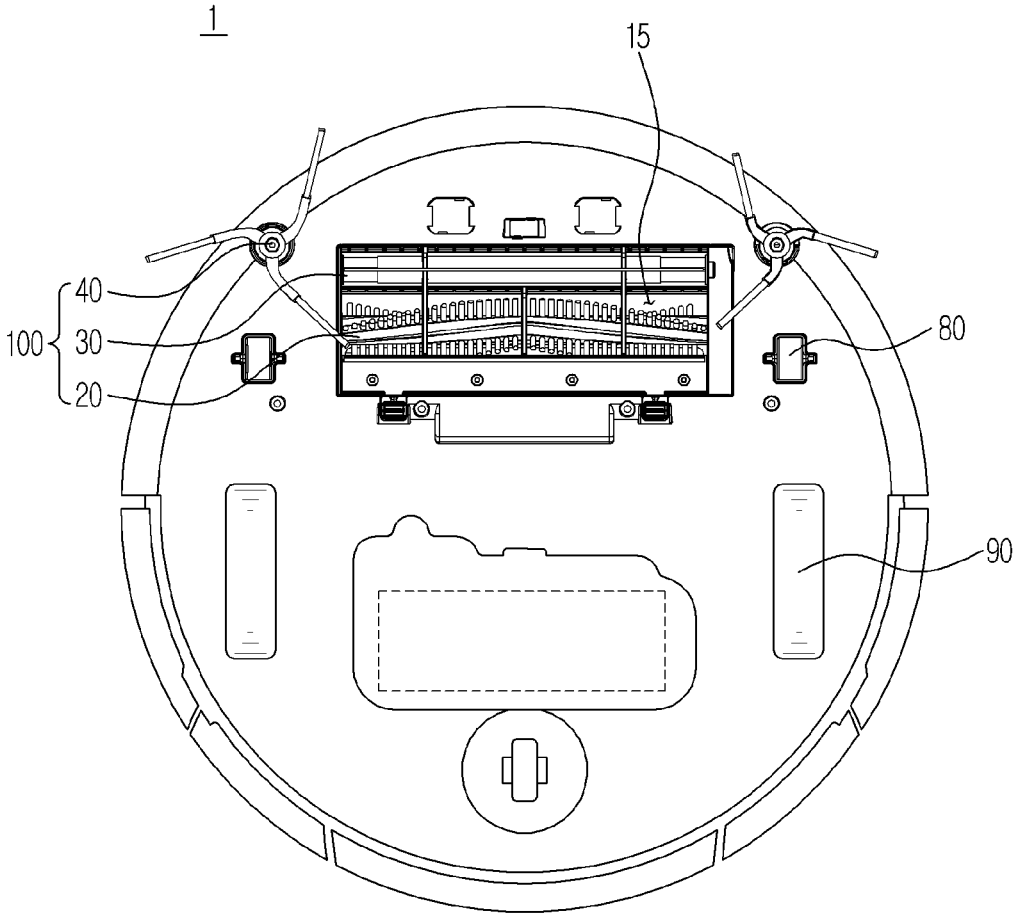
FIG. 2 is a view showing the bottom of a robot cleaner according to one or more embodiments.

FIG. 1 is a view showing a robot cleaner 1 according to one or more embodiments and FIG. 2 is a view showing the bottom of a robot cleaner 1 according to one or more embodiments.

The robot cleaner 1 may include a main body 10 forming the external appearance thereof and a brush assembly 100 (see FIG. 4) to sweep or scatter dust on a surface to be cleaned. The dust may mean dirt, motes, powder, scraps, and other dust particles which may be collected by an automatic or semi-automatic cleaning device including the robot cleaner.

The main body 10 may have various shapes. For example, the main body 10 may be formed in a circular shape. The circular main body 10 may have a uniform turning radius. During turning of the main body 10, therefore, the main body 10 may avoid contact with adjacent obstacles and may easily perform a change of direction. In addition, during travel of the main body 10, the main body 10 may be prevented from being caught by an obstacle and thus being jammed. In another example, the main body 10 may be formed in a quadrangular shape. In this case, cleaning may be satisfactorily performed even at a corner where walls are connected to each other.

The main body 10 may be provided at the top thereof with a display unit 12 to display various kinds of information, such as an operation state of the robot cleaner 1, quantity of dust, a battery charge level, and time. In addition, the main body 10 may be provided at the front thereof with a sensor window 50, upon which light reflected by an obstacle or a wall is incident, and a vision window 60 to acquire an image of a view above the main body 10 perpendicular to a travel direction. The robot cleaner 1 may determine a zone to be cleaned and move on a surface to be cleaned through the sensor window 50 and the vision window 60.

The main body 10 may include driving wheels 90, by which the main body moves about the surface to be cleaned. Two driving wheels 90 may be symmetrically disposed at left and right edges of the middle area of the bottom of the main body 10. In addition, the main body 10 may further include a plurality of auxiliary wheels 80 to smooth motion of the robot cleaner 1 moving through the driving wheels 90.

During cleaning, the robot cleaner 1 may move forward, move backward, or turn around due to the driving wheels 90 and the auxiliary wheels 80. For example, the two driving wheels 90 may be uniformly controlled such that the robot cleaner 1 moves forward or backward. In another example, the driving wheels 90 may be separately controlled such that the robot cleaner 1 turns around.

In addition, the main body 10 may include a suction port 15 to suction dust from the surface to be cleaned during travel of the main body 10. The suction port 15 may be provided at the bottom of the main body 10. The brush assembly 100 may be disposed in the suction port 15. The brush assembly 100 may include a main brush 20, an auxiliary brush 30, and a side brush 40.

The main brush 20 may be rotatably disposed in the suction port 15. The main brush 20 may sweep dust on a floor adjacent to the suction port 15 to guide the dust to the suction port 15. In the suction portion 15 may be provided a blower (not shown) to move the dust introduced into the suction port 14 to a dust collector (not shown) provided in the main body 10.

The auxiliary brush 30 may be rotatably disposed adjacent to the main brush 20. The main brush 20 and the auxiliary brush 30 may be arranged in parallel to each other. The auxiliary brush 30 will hereinafter be described in detail.

The side brush 40 may be provided to clean a side part or a corner part of the main body 10. The side brush 40 may be rotatably mounted at one side of the edge of the bottom of the main body 10. The side brush 40 may be mounted at a front diagonal position deviating from a middle area of the main body 10.

The side brush 40 may move dust around the main body 10 to the suction port 15. The side brush 40 may extend a cleaning range of the robot cleaner 1 to the circumference of the main body 10 including the bottom of the main body 10. As shown in FIGS. 1 and 2, a pair of side brushes 40 may be provided at the front of the main body 10. Only one side brush may be provided as needed. That is, the robot cleaner 1 may include at least one side brush 40.

Figure 3:
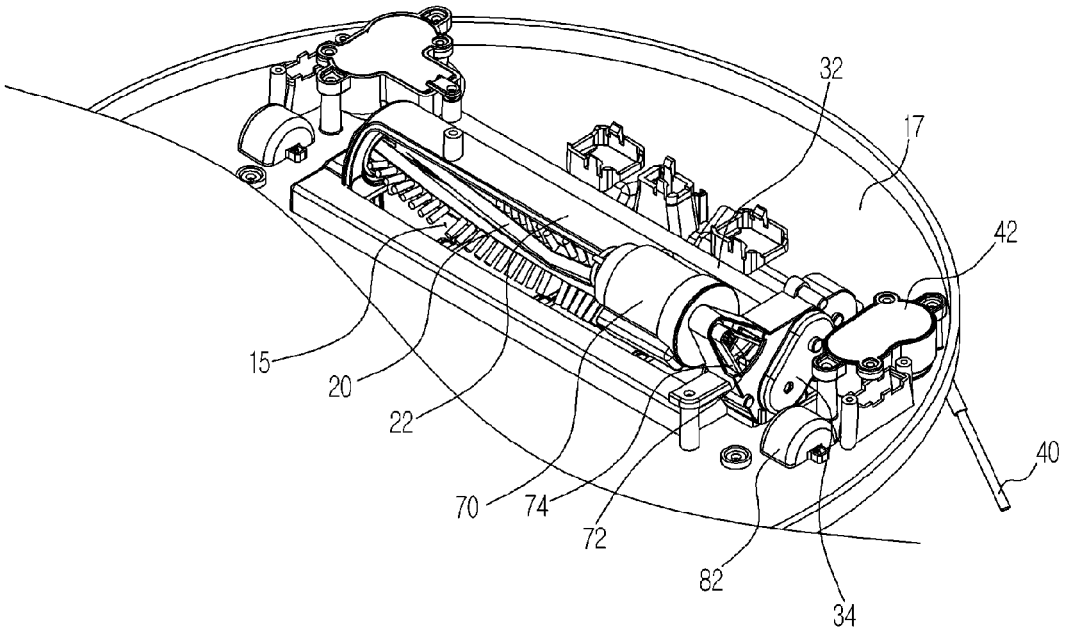
FIG. 3 is a view showing an installation unit of a robot cleaner according to one or more embodiments.
Figure 4:
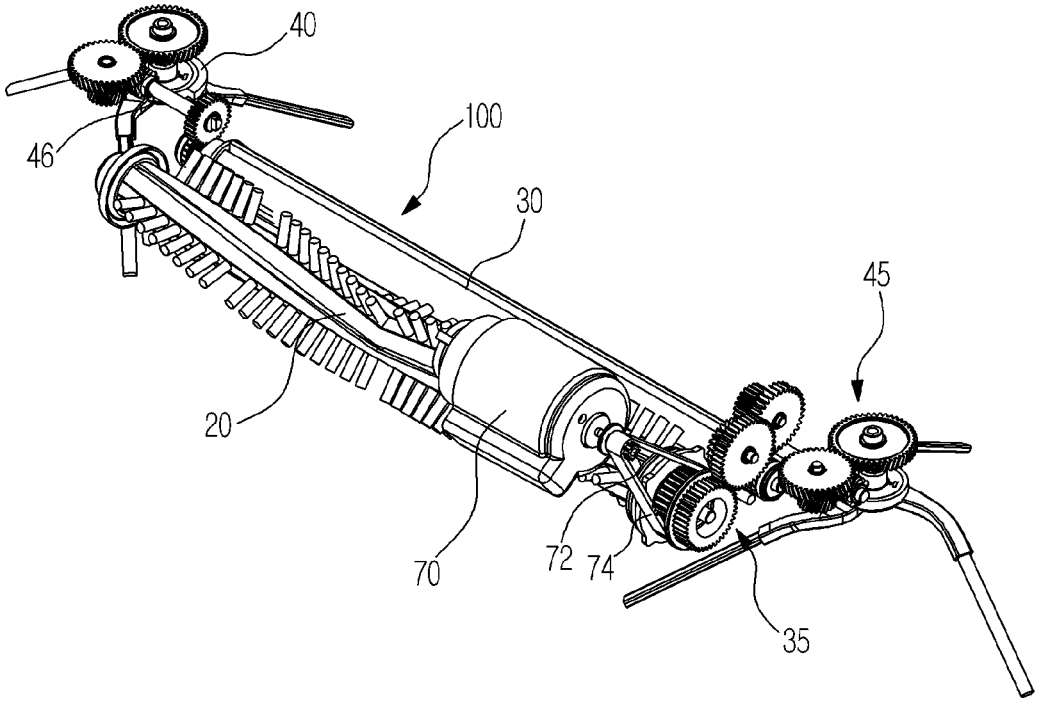
FIG. 4 is a view showing a brush assembly of a robot cleaner according to one or more embodiments.

FIG. 3 is a view showing an installation unit 17 of a robot cleaner 1 according to one or more embodiments and FIG. 4 is a view showing a brush assembly 100 of a robot cleaner according to one or more embodiments.

The main body 10 may include an installation unit 17, in which the brush assembly 100 may be installed. The brush assembly 100 may be rotatably mounted in the installation unit 17. The installation unit 17 may define a space in which the main brush 20, the auxiliary brush 30, and the side brush 40 may be installed. In addition, the installation unit 17 may include auxiliary wheel receiving parts 82 to receive the auxiliary wheels 80.

The installation unit 17 may include a first installation unit 22 defining the suction port 15. The main brush 20 may be disposed in the first installation unit 22. A second installation unit 32 may be provided adjacent to the first installation unit 22. The auxiliary brush 30 may be disposed in the second installation unit 32. A third installation unit 42, in which the side brush 40 may be received, may be provided at each side of the first installation unit 22 and the second installation unit 32.

A motor 70 to provide power to the brush assembly 100 may be disposed at the upper part of the installation unit 17. As shown in FIG. 4, the main brush 20, the auxiliary brush 30, and the side brush 40 may be connected to one another such that the main brush 20, the auxiliary brush 30, and the side brush 40 may be driven by the motor 70 in an interlocking fashion. The main brush 20, the auxiliary brush 30, and the side brush 40 may be provided in various forms to receive power from the motor 70.

For example, the main brush 20 may be connected to the motor 70 to receive power from the motor 70 and the power may be transmitted from the main brush 20 to the auxiliary brush 30 and the side brush 40. As shown in FIG. 4, the main brush 20 and the motor 70 may be connected to each other via a first connection member 74. In addition, the main brush 20 and the auxiliary brush 30 may be connected to each other via a second connection member 35 and the auxiliary brush 30 and the side brush 40 may be connected to each other via a third connection member 45.

The installation unit 17 may include a second connection member installation unit 34 disposed between the second installation unit 32 and the third installation unit 42. The third connection member 45 may be disposed in the third installation unit 42. The first connection member 74 may be disposed at one side of the first installation unit 22.

As shown in FIG. 4, the motor 70, the main brush 20, and the auxiliary brush 30 may include rotary shafts parallel to the surface to be cleaned and the side brush 40 may include a rotary shaft perpendicular to the surface to be cleaned. That is, when a rotary shaft 72 of the motor 70 is provided in a first direction, the main brush 20 and the auxiliary brush 30 may include rotary shafts provided in the first direction and the side brush 40 may include a rotary shaft provided in a second direction perpendicular to the first direction.

Consequently, the second connection member 35 may be rotatably installed along a rotary shaft provided in the first direction to interconnect the main brush 20 and the auxiliary brush 30 disposed in parallel to each other in the first direction. In addition, the third connection member 45 may include a worm gear 46 to interlock the auxiliary brush 30 and the side brush 40 perpendicularly coupled to each other.

Hereinafter, a coupling relationship between the motor 70 and the brush assembly 100 and the shape of the brush assembly 100 will be described in detail.

Figure 5:
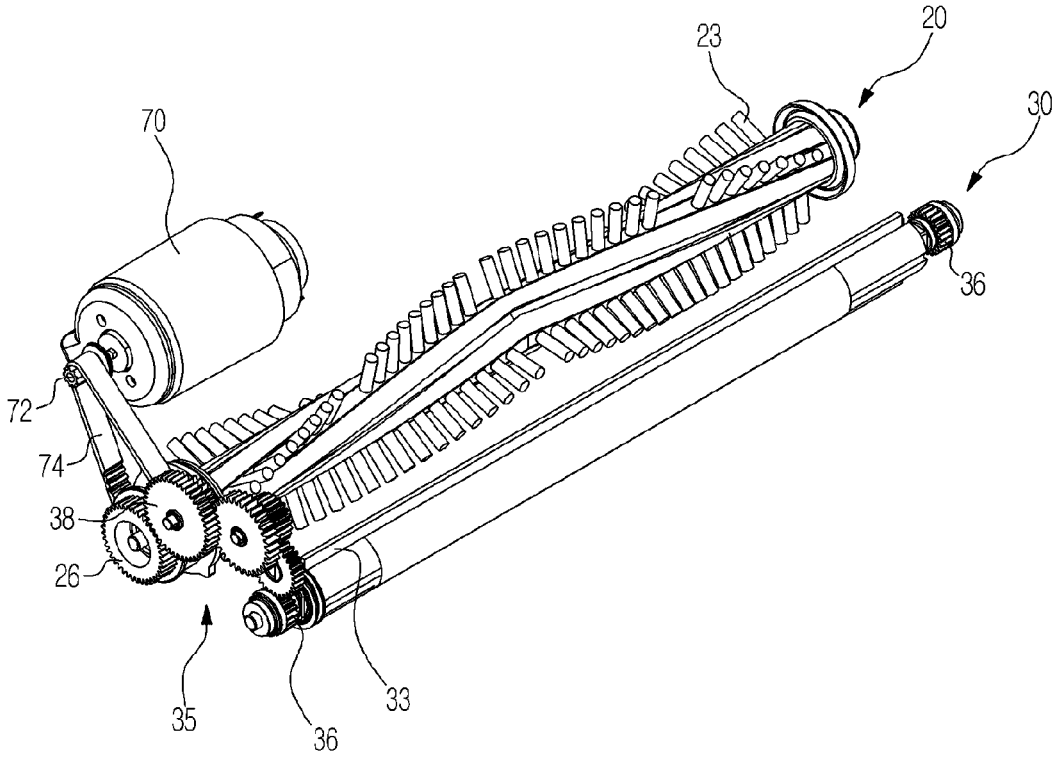
FIG. 5 is a view showing a main brush and an auxiliary brush of a robot cleaner according to one or more embodiments.

FIG. 5 is a view showing the main brush 20 and the auxiliary brush 30 of a robot cleaner according to one or more embodiments. For the convenience of description, the side brush 40 is omitted from FIG. 5.

As previously described, the motor 70, the main brush 20, and the auxiliary brush 30 may rotate about the rotary shafts extending in the same direction. As shown in FIG. 5, the motor 70, the main brush 20, and the auxiliary brush 30 may be arranged in parallel to one another.

The motor 70 may include a rotary shaft 72 protruding from one side thereof. The first connection member 74 may connect the rotary shaft 72 of the motor 70 to the main brush 20. The main brush 20 may be formed in the shape of a rotatable drum. The main brush 20 may include a plurality of brushes 23 disposed at the outer circumference thereof. The brushes 23 may be made of various materials exhibiting elasticity.

A main gear 26 may be coupled to one side of the main brush 20. The main gear 26 may be connected to the rotary shaft 72 of the motor 70 via the first connection member 74 such that the main brush 20 receives power from the motor 70. As shown in FIG. 5, the first connection member 74 may be provided, for example, in the form of a belt to connect the main gear 26 to the rotary shaft 72 of the motor 70.

The auxiliary brush 30 may be provided as a rotary shaft arranged in parallel to the main brush 20 and extending in the same direction. The auxiliary brush 30 may be disposed in front of the main brush 20 to move dust on the surface to be cleaned to the suction port 15.

The auxiliary brush 30 may be connected to the main brush 20 via the second connection member 35 to receive power from the motor 70. The auxiliary brush 30 may include auxiliary gears 36 coupled to opposite sides thereof. The second connection member 35 may include at least one gear 38 to interconnect the auxiliary gear 36 provided at one side of the auxiliary brush 30 and the main gear 26.

The at least one gear 38 included in the second connection member 35 may rotate about a rotary shaft provided in the same direction as the main brush 20 and the auxiliary brush 30. The second connection member 35 may interconnect the main brush 20 and the auxiliary brush 30 such that the main brush 20 and the auxiliary brush 30 may rotate in the same direction. In addition, the second connection member 35 may include a plurality of gears 30 having different speed reduction ratios such that the main brush 20 and the auxiliary brush 30 may rotate at different speeds.

Figure 6A:
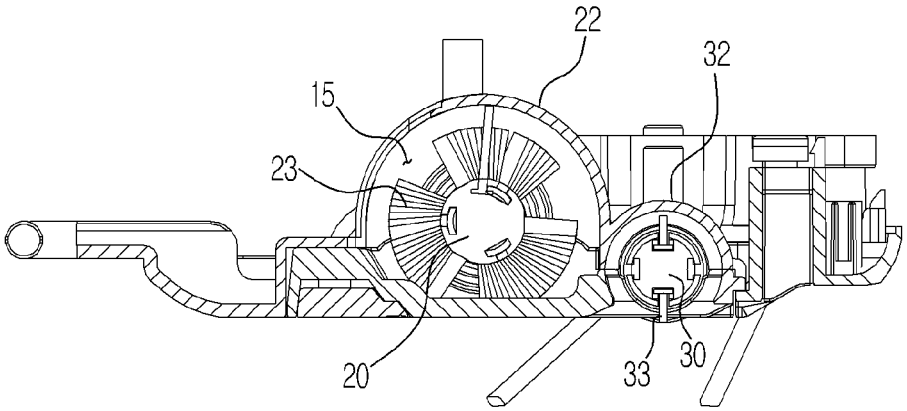
FIGS. 6A and 6B are views showing operation of an auxiliary brush of a robot cleaner according to one or more embodiments.
Figure 6B:
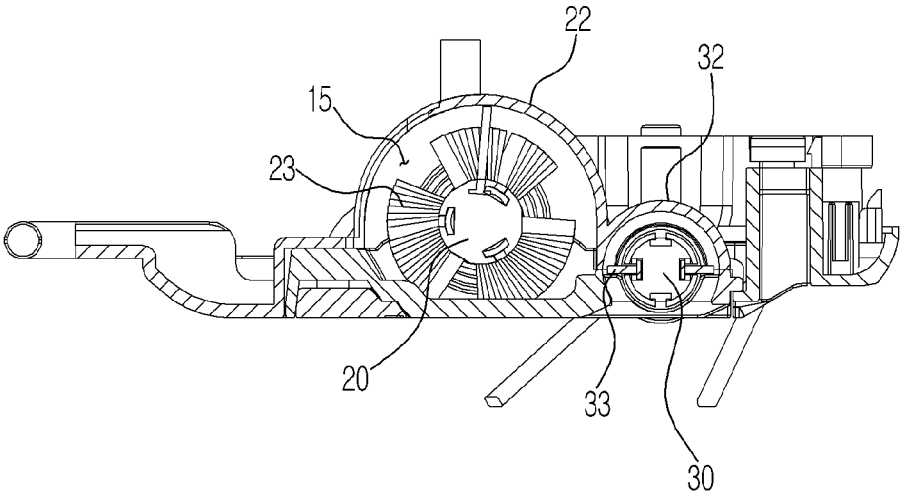

FIGS. 6A and 6B are views showing operation of an auxiliary brush 30 of a robot cleaner 1 according to one or more embodiments. For the convenience of description, the motor 70 is omitted from FIGS. 6A and 6B and the side brush 40 is schematically shown in FIGS. 6A and 6B.

As shown in FIGS. 6A and 6B, the main brush 20 and the auxiliary brush 30 may be disposed such that the main brush 20 and the auxiliary brush 30 may be at least partially received in the first installation unit 22 and the second installation unit 32, respectively. The suction port 15 may be provided at one side of the first installation unit 22 opposite to the other side of the first installation unit 22 where the first installation unit 22 may contact the second installation unit 32.

As shown in FIG. 5, the auxiliary brush 30 may include at least one blade 33 extending along the rotary shaft thereof. The at least one blade 33 may protrude perpendicular to an axial direction of the auxiliary brush 30. The blade 33 may move dust on the surface to be cleaned to the suction port 15 according to rotation of the auxiliary brush 30. A plurality of blades 33 may be provided at the outer circumference of the auxiliary brush 30.

FIGS. 6A and 6B show a pair of symmetric blades 33. The blades 33 may rotate according to rotation of the auxiliary brush 30. The blades 33 may be disposed in parallel to a floor or perpendicular to the floor. FIG. 6A shows a case in which one of the blades 33 is disposed perpendicular to the floor and thus is adjacent to the surface to be cleaned. FIG. 6B shows a case in which the blades 33 are disposed in parallel to the floor and thus are away from the surface to be cleaned.

In FIG. 6A, the blades 33 are positioned adjacent to the surface to be cleaned to narrow an area to be suctioned by the suction port 15. As a narrow area is suctioned using the same power, suction force of the robot cleaner 1 may be greatly increased. In FIG. 6B, the blades 33 are positioned away from the surface to be cleaned with the result that a suction area is increased. Consequently, large-sized dust particles may be suctioned through the auxiliary brush 30.

The auxiliary brush 30 may be disposed at the front of the main body 10 such that the auxiliary brush 30 may be positioned more forward than the main brush 20. As a result, the auxiliary brush 30 may sweep large-sized dust particles on the floor and move the dust particles to the main brush 20 during rotation of the auxiliary brush 30. In addition, dust on the floor may be scattered by an air stream generated during rotation of the blades and the scattered dust may be suctioned into the suction port through the main brush. That is, suction efficiency of the robot cleaner may be improved by the provision of the auxiliary brush.

As previously described, the main brush 20 and the auxiliary brush 30 may be connected to each other via the second connection member 35 such that the auxiliary brush 30 is rotatable according to rotation of the main brush 20. Alternatively, the main brush 20 and the auxiliary brush 30 may be rotatable by different motors. The auxiliary brush 30, the second connection member 35, and the blades 33 may constitute an auxiliary unit.

Figure 7:
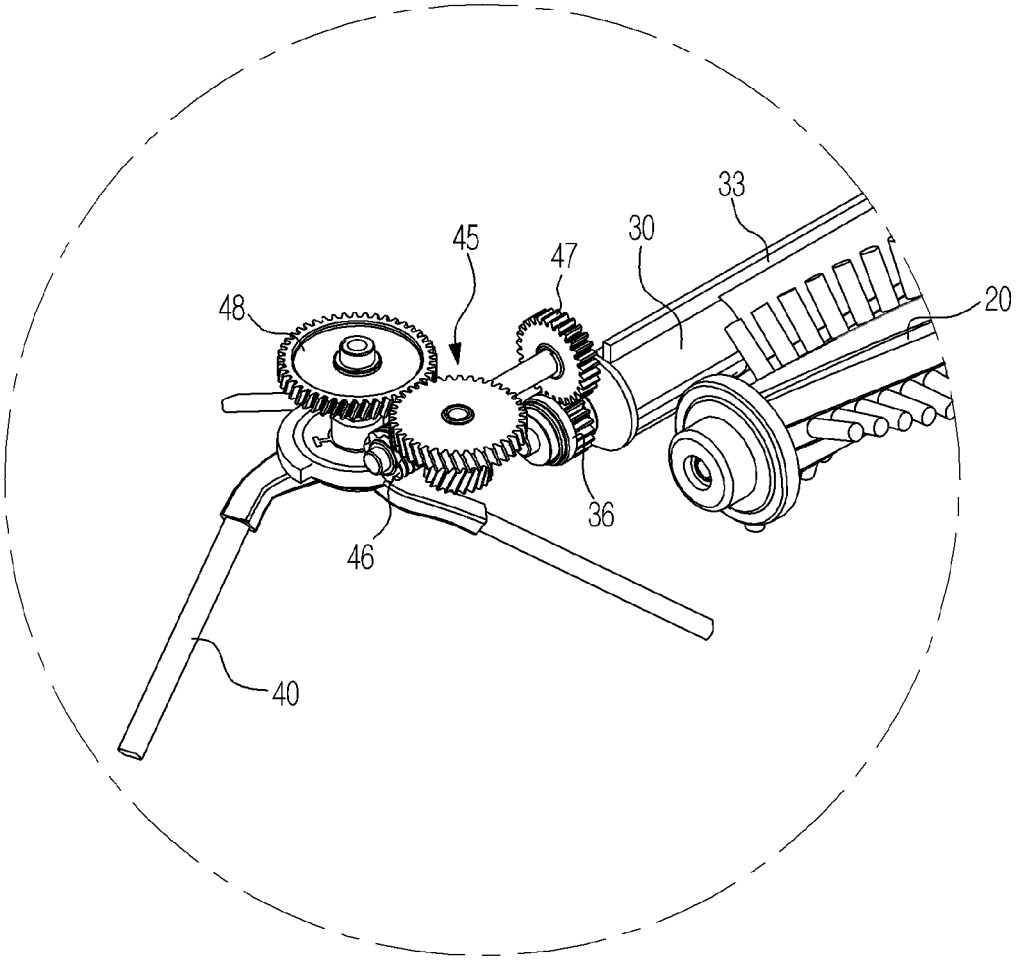
FIG. 7 is a view showing a first side brush of a robot cleaner according to one or more embodiments.

FIG. 7 is a view showing a first side brush 40 of a robot cleaner 1 according to one or more embodiments. Unlike the auxiliary brush 30 and the main brush 20, which may be connected to each other at one side of the auxiliary brush 30 and one side of the main brush 20, a pair of side brushes 40 may be coupled to opposite sides of the auxiliary brush 30. The first side brush means a side brush 40 coupled to one side of the auxiliary brush 30 opposite to the other side of the auxiliary brush 30 at which the auxiliary brush 30 is coupled to the main brush 20. For the convenience of description, the first side brush will be referred to as a side brush 40.

The side brush 40 may be coupled to one side of the auxiliary brush 30. When a pair of side brushes 40 is provided, the side brushes 40 may be coupled to opposite sides of the auxiliary brush 30. The side brush 40 may be connected to the auxiliary brush 30 via the third connection member 45. As previously described, the third connection member 45 may be provided to interconnect rotary shafts perpendicular to each other unlike the second connection member 35 to interconnect the main brush 20 and the auxiliary brush 30 having the rotary shafts provided in the same direction.

The third connection member 45 may include a plurality of gears 46, 47, and 48 to interconnect the auxiliary brush 30 rotating about the rotary shaft provided as a horizontal shaft and the side brush 40 rotating about the rotary shaft provided as a vertical shaft. Specifically, the third connection member 45 may include a horizontal gear 47 rotating about a horizontal shaft, a vertical gear 48 rotating about a vertical shaft, and a worm gear 46 connected between the horizontal gear 47 and the vertical gear 48. The auxiliary gear 36 provided at one side of the auxiliary brush 30 may be engaged with the horizontal gear 47 and the horizontal gear 47 may be connected to the worm gear 46. The worm gear 46 may be connected to the vertical gear 48 and the vertical gear 48 may be coupled to the side brush 40.

In addition, the third connection member 45 may include at least one gear 46, 47, and 48 having different speed reduction ratios such that the auxiliary brush 30 and the side brush 40 may rotate at different speeds. Consequently, the main brush 20, the auxiliary brush 30, and the side brush 40 may rotate at different speeds due to the third connection member 45 and the third connection member 45 including the gears having different speed reduction ratios.

Figure 8:
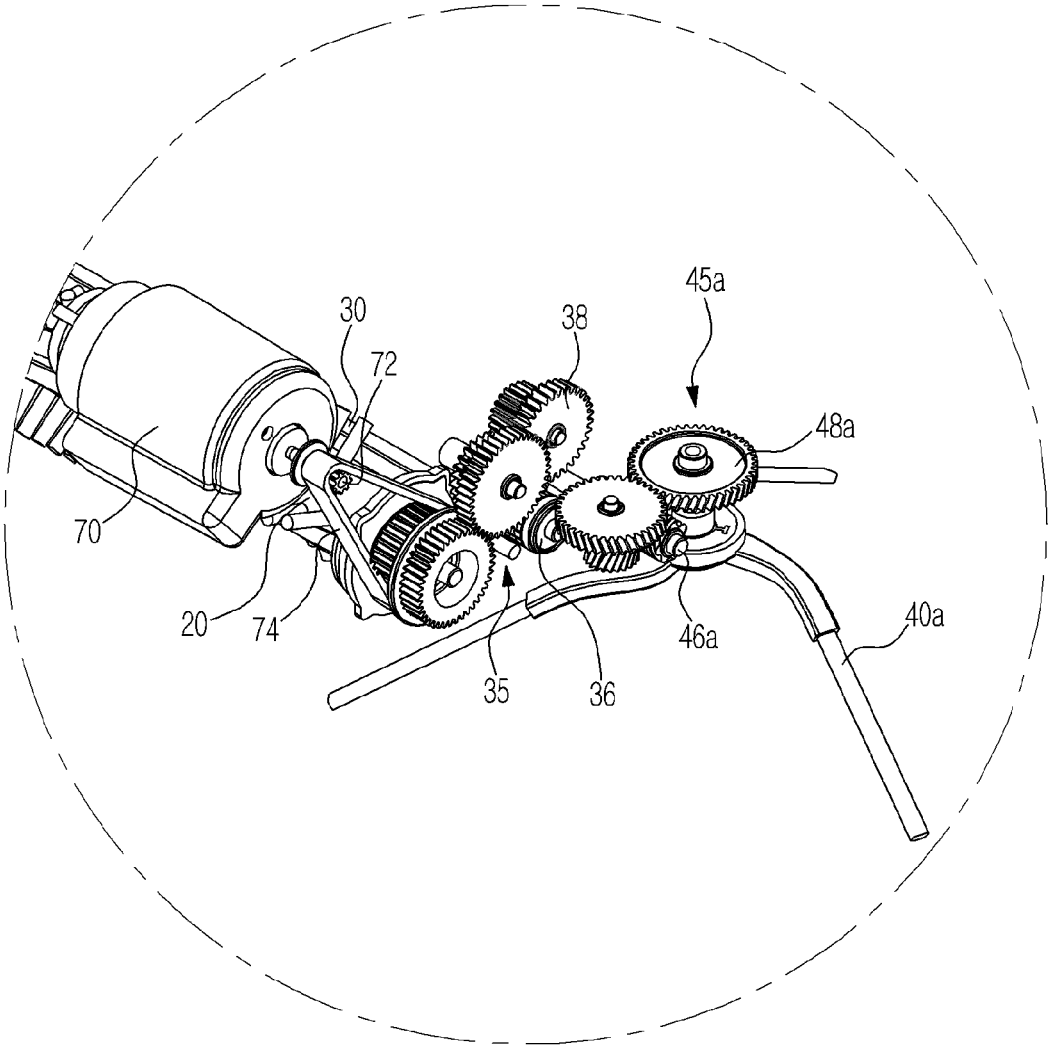
FIG. 8 is a view showing a second side brush of a robot cleaner according to one or more embodiments.

FIG. 8 is a view showing a second side brush 40*a* of a robot cleaner 1 according to one or more embodiments. The second side brush means a side brush 40*a* coupled to the side of the auxiliary brush 30 at which the auxiliary brush 30 is coupled to the main brush 20. That is, the structure of FIG. 8 may include the structure of FIG. 7 showing coupling between the auxiliary brush 30 and the first side brush 40 and the structure of FIG. 5 showing coupling between the main brush 20 and the auxiliary brush 30. For the convenience of description, the second side brush will be referred to as a side brush 40*a*.

Coupling for a third connection member 45*a* may be applied in addition to coupling for the first connection member 72 and the second connection member 35 as previously described. The auxiliary gear 36 provided at one side of the auxiliary brush 30 may be coupled to a horizontal gear of the third connection member 45*a* and the horizontal gear may be connected to the second connection member 35 and a worm gear 46*a*. That is, the worm gear 46*a* extends in an axial direction of the horizontal gear and the horizontal gear is engaged with the gear of the second connection member 35.

When the motor 70 is driven to rotate the rotary shaft 72, the first connection member 72 connected to the rotary shaft 72 may transmit power to the main gear 26. The main brush 20 and the gear 38 of the second connection member 35 may be rotated according to rotation of the main gear 26. In addition, the horizontal gear engaged with the second connection member 35 may be rotated. As a result, the worm gear 46*a* of the auxiliary gear 36 coupled to the horizontal gear may be rotated. In addition, the auxiliary brush 30 and a vertical gear 48*a* may be rotated. The side brush 40*a* coupled to the vertical gear 48*a* may be rotated according to rotation of the vertical gear 48*a*.

The first connection member, the second connection member, and the third connection member may constitute a single connection member. That is, the main brush, the auxiliary brush, and the side brush may be configured to receive power from a single motor.

As is apparent from the above description, in a robot cleaner according to embodiments of the present invention, a main brush, an auxiliary brush, and at least one side brush may be driven by a single motor in an interlocking fashion.

In addition, the auxiliary brush may be provided to assist the main brush, thereby improving suction efficiency.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A robot cleaner to remove dust from a surface to be cleaned, the robot cleaner comprising:

a main body having a suction port;

a main brush rotatably disposed in the suction port;

an auxiliary brush rotatably disposed adjacent to the main brush; and at least one side brush rotatably installed to move the dust to the suction port, wherein the main brush, the auxiliary brush, and the at least one side brush are driven by a single motor, wherein the auxiliary brush and the at least one side brush are interconnected with a plurality of gears, and wherein the auxiliary brush rotates about a horizontal shaft and the at least one side brush rotates about a vertical shaft.

2. The robot cleaner according to claim 1, wherein the main brush and the auxiliary brush are arranged side by side.

3. The robot cleaner according to claim 1, wherein the main brush comprises a first rotary shaft parallel to the surface and the auxiliary brush comprises a second rotary shaft parallel to the surface, and the at least one side brush comprises a third rotary shaft perpendicular to the surface.

4. The robot cleaner according to claim 1, wherein the single motor is connected to the main brush via a connection member, and the connection member interconnects a rotary shaft of the single motor and one side of the main brush.

5. The robot cleaner according to claim 1, wherein the main brush is connected to the auxiliary brush via a connection member.

6. The robot cleaner according to claim 5, wherein the connection member interconnects one side of the main brush and one side of the auxiliary brush.

7. The robot cleaner according to claim 6, wherein the connection member comprises at least one gear to interconnect the main brush and the auxiliary brush such that the main brush and the auxiliary brush are rotatable in a same direction.

8. The robot cleaner according to claim 5, wherein the connection member interconnects one side of the main brush, one side of the auxiliary brush, and the at least one side brush.

9. The robot cleaner according to claim 8, wherein the connection member comprises a plurality of gears having different speed reduction ratios such that the main brush, the auxiliary brush, and the at least one side brush are rotatable at different speeds.

10. The robot cleaner according to claim 1, wherein the main body comprises an installation unit defining the suction port, and the installation unit comprises a first installation unit, in which the main brush is installed, and a second installation unit, in which the auxiliary brush is installed.

11. The robot cleaner according to claim 1, wherein the auxiliary brush comprises at least one blade to move the dust on the surface to the suction port.

12. The robot cleaner according to claim 11, wherein the at least one blade protrudes perpendicular to an axial direction of the auxiliary brush to move the dust according to a rotation of the auxiliary brush.

13. The robot cleaner according to claim 1, wherein the auxiliary brush is disposed in front of the main brush to move the dust on the surface to the suction port.

14. The robot cleaner according to claim 1, wherein the main brush is rotatable about a first rotary shaft, the auxiliary brush is rotatable about a second rotary shaft, and the at least one side brush is rotatable about a third rotary shaft, and wherein the second rotary shaft of the auxiliary brush and the third rotary shaft of the at least one side brush are interconnected with the plurality of gears and are not parallel to each other.

15. The robot cleaner according to claim 14, wherein the second rotary shaft of the auxiliary brush and the third rotary shaft of the at least one side brush are perpendicular to each other.

* * * * *